US007157044B2

(12) United States Patent
Rolander et al.

(10) Patent No.: US 7,157,044 B2
(45) **Date of Patent: *Jan. 2, 2007**

(54) TI(C,N)-(TI,NB,W)(C,N)-CO ALLOY FOR FINISHING AND SEMIFINISHING TURNING CUTTING TOOL APPLICATIONS

(75) Inventors: Ulf Rolander, Stockholm (SE); Marco Zwinkels, Sundbyberg (SE); Gerold Weinl, Älvsjö (SE)

(73) Assignee: Sandvik Intellectual Property AB, Sandviken (SE)

( * ) Notice: Subject to any disclaimer, the term of this patent is extended or adjusted under 35 U.S.C. 154(b) by 449 days.

This patent is subject to a terminal disclaimer.

(21) Appl. No.: 10/679,379

(22) Filed: Oct. 7, 2003

(65) Prior Publication Data

US 2004/0115082 A1 Jun. 17, 2004

(30) Foreign Application Priority Data

Nov. 19, 2002 (SE) ..... 0203409

(51) Int. Cl.
*C22C 33/02* (2006.01)
*C22C 29/04* (2006.01)
*C22C 32/00* (2006.01)

(52) U.S. Cl. ..... 419/13; 419/23

(58) Field of Classification Search ..... 419/13, 419/23

See application file for complete search history.

(56) References Cited

U.S. PATENT DOCUMENTS 3,994,692 A 11/1976 Rudy
5,137,565 A * 8/1992 Thelin et al. ..... 75/238
5,308,376 A * 5/1994 Oskarsson ..... 75/238
5,314,657 A * 5/1994 Ostlund ..... 419/15
5,370,719 A 12/1994 Teruuchi et al.
5,470,372 A * 11/1995 Weinl ..... 75/238
5,545,248 A * 8/1996 Tokumoto et al. ..... 75/238
5,682,590 A * 10/1997 Weinl ..... 419/15
5,939,651 A * 8/1999 Isobe et al. ..... 75/236
6,004,371 A 12/1999 Rolander et al.
6,344,170 B1 2/2002 Rolander et al.

FOREIGN PATENT DOCUMENTS

EP 0 872 566 A1 10/1998
EP 1 052 297 A1 11/2000
EP 1052297 A 11/2000
EP 1052300 A 11/2000
JP 60002646 A * 1/1985
JP 02213445 A * 8/1990
JP 6-248385 9/1994

* cited by examiner

*Primary Examiner*—Roy King
*Assistant Examiner*—Michael P. Alexander
(74) *Attorney, Agent, or Firm*—Drinker Biddle & Reath LLP

(57) ABSTRACT

A titanium based carbonitride alloy contains Ti, Nb, W, C, N and Co. The alloy also contains, in addition to Ti, Co with only impurity levels of Ni and Fe, 4–7 at % Nb, 3–8 at % W and has a C/(C+N) ratio of 0.50–0.75. The Co content is 9–<12 at % for general finishing applications and 12–16% for semifinishing applications. The amount of undissolved Ti(C,N) cores must be kept between 26 and 37 vol % of the hard constituents, the balance being one or more complex carbonitrides containing Ti, Nb and W. The invented alloy is particularly useful for semifinishing of steel and cast iron.

12 Claims, 1 Drawing Sheet

TI(C,N)-(TI,NB,W)(C,N)-CO ALLOY FOR FINISHING AND SEMIFINISHING TURNING CUTTING TOOL APPLICATIONS

This application claims priority under 35 U.S.C. §119 to Swedish Application No. SE 0203409-8 filed in Sweden on Nov. 19, 2002; the entire contents of which is hereby incorporated by reference.

FIELD OF THE INVENTION

The present invention relates to a sintered carbonitride alloy with Ti as the main component and a Ni-free binder phase which has improved properties particularly when used as cutting tool material in finishing turning operations particularly for semifinishing of steel and cast iron. More particularly, the present invention relates to a carbonitride-based alloy of specific composition, for which the amount of undissolved Ti(C,N) cores is optimized for maximal abrasive wear resistance, while the Co and Nb contents are simultaneously optimized to give the desired toughness and resistance to plastic deformation.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention. Titanium-based carbonitride alloys, so called cermets, are produced by powder metallurgical methods. Compared to WC—Co based materials, cermets have excellent chemical stability when in contact with hot steel, even if the cermet is uncoated, but have substantially lower strength. This makes them most suited for finishing operations, which generally are characterized by limited mechanical loads on the cutting edge and a high surface finish requirement on the finished component. Cermets comprise carbonitride hard constituents embedded in a metallic binder phase generally of Co and Ni. The hard constituent grains generally have a complex structure with a core, most often surrounded by one or more rims having a different composition. In addition to Ti, group VIA elements, normally both Mo and W, are added to facilitate wetting between binder and hard constituents and to strengthen the binder phase by means of solution hardening. Group IVA and/or VA elements, e.g. —Zr, Hf. V, Nb, and Ta, are also added in all commercial alloys available today.

Cermets are produced using powder metallurgical methods. Powders forming binder phase and powders forming hard constituents of cermets are mixed, pressed and sintered. The carbonitride forming elements are added as simple or complex carbides, nitrides and/or carbonitrides. During sintering the hard constituents dissolve partly or completely in the liquid binder phase. Some, such as WC, dissolve easily whereas others, such as Ti(C,N), are more stable and may remain partly undissolved at the end of the sintering time. During cooling the dissolved components precipitate as a complex phase on undissolved hard phase particles or via nucleation in the binder phase forming the abovementioned core-rim structure.

During recent years many attempts have been made to control the main properties of cermets in cutting tool applications, namely toughness, wear resistance and plastic deformation resistance. Much work has been done especially regarding the chemistry of the binder phase and/or the hard phase and the formation of the core-rim structures in the hard phase. Most often only one, or at the most two, of the three properties are able to be optimized at the same time, at the expense of the third property.

U.S. Pat. No. 5,308,376 discloses a cermet in which at least 80 vol % of the hard phase constituents comprises core-rim structured particles having several, preferably at least two, different hard constituent types with respect to the composition of core and/or rim(s). These individual hard constituent types each consist of 10–80%, preferably 20–70% by volume of the total content of hard constituents.

JP-A-6-248385 discloses a Ti—Nb—W—C—N-cermet in which more than 1 vol % of the hard phase comprises coreless particles, regardless of the composition of those particles.

EP-A-872 566 discloses a cermet in which particles of different core-rim ratios coexist. When the structure of the titanium-based alloy is observed with a scanning electron microscope, particles forming the hard phase in the alloy have black core parts and peripheral parts which are located around the black core parts and appear grey. Some particles have black core parts occupying areas of at least 30% of the overall particles referred to as big cores and some have the black core parts occupying areas of less than 30% of the overall particle area are referred to as small cores. The amount of particles having big cores is 30–80% of total number of particles with cores.

U.S. Pat. No. 6,004,371 discloses a cermet comprising different microstructural components, namely cores which are remnants of and have a metal composition determined by the raw material powder, tungsten-rich cores formed during the sintering, outer rims with intermediate tungsten content formed during the sintering and a binder phase of a solid solution of at least titanium and tungsten in cobalt. Toughness and wear resistance are varied by adding WC, (Ti,W)C, and/or (Ti,W)(C,N) in varying amounts as raw materials.

U.S. Pat. No. 3,994,692 discloses cermet compositions with hard constituents consisting of Ti, W and Nb in a Co binder phase. The technological properties of these alloys as disclosed in the patent are not impressive.

A significant improvement compared to the above disclosures was presented in U.S. Pat. No. 6,344,170. By optimizing composition and sintering process using the Ti—Ta—W—C—N—Co system improved toughness and resistance to plastic deformation was accomplished. The two parameters that were used to optimize toughness and resistance to plastic deformation were Ta and Co content. The use of pure Co-based binder implied a major advantage over mixed Co—Ni-based binders with respect to the toughness behavior due to the differences in solution hardening behavior between Co and Ni. There is, however, no teaching how to optimize abrasive wear resistance simultaneously with the other two performance parameters. Hence, the abrasive wear resistance is still not optimal, which is crucial for most finishing operations.

SUMMARY OF THE INVENTION

It is an object of the present invention to solve the problem described above and others. It is a further object to provide a cermet material with substantially improved wear resistance while maintaining toughness and resistance to plastic deformation on the same level as state-of-the-art cermets.

According to a first aspect, the present invention provides a titanium based carbonitride alloy comprising hard constituents with undissolved Ti(C,N) cores, the alloy further comprising: 9–16 at % Co, 4–7 at % Nb, 3–8 at % W, C and N having a C/(N+C) ratio of 0.50–0.75, and wherein the amount of undissolved Ti(C,N) cores is between 26 and 37 vol % of the hard constituents and the balance being one or more complex carbonitride phases.

According to a second aspect, the present invention provides a method of manufacturing a sintered titanium-based carbonitride alloy comprising hard constituents with undissolved Ti(C,N) cores, the method comprising mixing hard constituent powders of $TiC_xN_{1-x}$, x having a value of 0.46–0.70, NbC and WC with powder of Co, pressing the mixture into bodies of desired shape and sintering the bodies in a $N_2$—CO—Ar atmosphere at a temperature in the range 1370–1500° C. for 1.5–2 h to obtain the desired amount of undissolved Ti(C,N) cores, wherein the amount of Ti(C,N) powder is 50–70 wt-% of the powder mixture, its grain size is 1–3 μm, and the sintering temperature and sintering time are chosen to give an amount of undissolved Ti(C,N) cores between 26 and 37 vol % of the hard constituents.

DETAILED DESCRIPTION OF THE INVENTION

Figure 1:
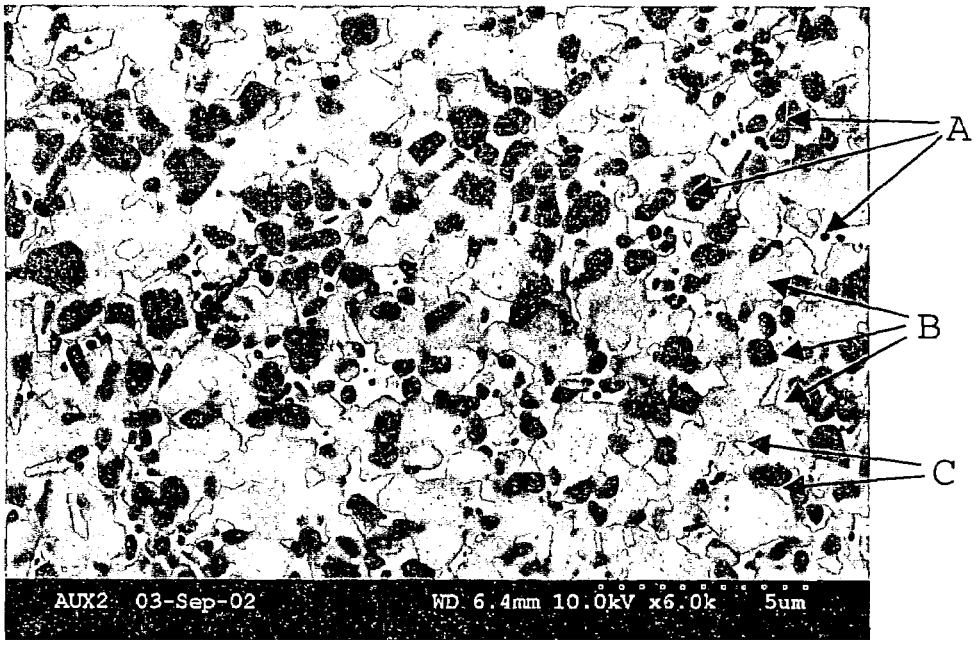
FIG. 1 is a scanning electron micrograph illustrating the microstructure of an alloy of the present invention.

It has been found possible to design and produce a material with substantially improved wear resistance while maintaining toughness and resistance to plastic deformation on the same level as state-of-the-art cermets. This has been achieved by working with the alloy system Ti—Nb—W—C—N—Co.

Within the system Ti—Nb—W—C—N—Co a set of constraints has been found rendering optimum properties for the intended application areas. More specifically, the abrasive wear resistance was maximized for a given level of toughness and resistance to plastic deformation by optimizing the amount of undissolved Ti(C,N) cores. The amount of undissolved Ti(C,N) cores can be varied independently from other parameters, such as Nb and binder content. Hence, it has been possible to simultaneously optimize all three main cutting performance criteria, i.e. toughness, abrasive wear resistance and resistance to plastic deformation.

FIG. 1 shows the microstructure of an alloy according to the invention in which A depicts undissolved Ti(C,N)-cores, B depicts a complex carbonitride phase sometimes surrounding the A-cores, and C depicts the Co binder phase.

In one aspect, the present invention provides a titanium based carbonitride alloy containing Ti, Nb, W, C, N and Co, which is particularly useful for finishing operations. The alloy can be characterized in that the binder phase comprises 9–16 at % Co. Besides Co, the alloy contains Ti, Nb, W, C and N. When observed in back scattering mode in a scanning electron microscope the structure has black cores of Ti(C,N), A, a grey complex carbonitride phase, B, sometimes surrounding the A-cores and an almost white Co binder phase, C, as depicted in FIG. 1.

According to the present invention it has unexpectedly been found that the abrasive wear resistance could be maximized for a given level of toughness and resistance to plastic deformation by optimizing the amount of undissolved Ti(C,N)-cores (A). A large amount of undissolved cores is favorable for the abrasive wear resistance. However, the maximum amount of these cores is limited by the demand for sufficient toughness for a specific application since toughness decreases at high levels of undissolved cores. This amount should therefore be kept at 26 to 37 vol % of the hard constituents, preferably 27 to 35 vol %, most preferably 28 to 32 vol %, the balance being one or more complex carbonitride phases containing Ti, Nb and W.

The composition of the Ti(C,N)-cores can be more closely defined as $TiC_xN_{1-x}$. The C/(C+N) atomic ratio, x, in these cores should be in the range 0.46–0.70, preferably 0.52–0.64, most preferably 0.55–0.61.

The overall C/(C+N) ratio in the sintered alloy should be in the range 0.50–0.75.

The average grain size of the undissolved cores, A, should be 0.1–2 μm and the average grain size of the hard phase including the undissolved cores 0.5–3 μm.

The Nb and Co contents should be chosen properly to give the desired properties for the envisioned application area.

General finishing applications place high demands on productivity and reliability, which translates to the need for high resistance to plastic deformation and abrasive wear and relatively high toughness. This combination is best achieved by Co contents of 9 to <12 at %, preferably 9 to 10.5 at %.

Semifinishing applications place even higher demands on toughness, which is achieved by increasing the Co content. The Co content should be 12 to 16 at %, preferably 12 to 14.5 at %.

For both general finishing and semifinishing operations the Nb content should be 4 to 7 at %, preferably 4 to 5.5 at % and the W content 3 to 8 at %, preferably less than 4 at %, to avoid an unacceptably high porosity level.

For cutting operations requiring high wear resistance it is advantageous to coat the body of the present invention with a thin wear resistant coating using PVD, CVD, MTCVD or similar techniques. It should be noted that the composition of the insert is such that any of the coatings and coating techniques used today for WC—Co based materials or cermets may be directly applied, though of course the choice of coating will also influence the deformation resistance and toughness of the material.

In another aspect of the invention, there is provided a method of manufacturing a sintered titanium-based carbonitride alloy in which hard constituent powders of $TiC_xN_{1-x}$, wherein x is 0.46–0.70, preferably 0.52–0.64, most preferably 0.55–0.61, NbC and WC, are mixed with powder of Co to a composition as defined above and pressed into bodies of desired shape. Sintering is performed in an $N_2$—CO—Ar atmosphere at a temperature in the range 1370–1500° C. for 1.5–2 h, preferably using the technique described in EP-A-1052297. In order to obtain the desired amount of undissolved Ti(C,N) cores the amount of Ti(C,N) powder should be 50–70 wt-%, its grain size 1–3 μm and the sintering temperature and sintering time have to be chosen adequately.

The principles of the present invention will now be further described by reference to the following illustrative, non-limiting examples.

EXAMPLE 1

A powder mixture of nominal composition (at %) Ti 37.0%, W 3.7%, Nb 4.5%, Co 9.7% and a N/(N+C) ratio of 0.62 (Alloy A) was prepared by wet milling:

56.6 wt-% $TiC_{0.58}N_{0.42}$ with a grain size of 1.43 μm 11.7 wt-% NbC grain size 1.75 μm 17.4 wt-% WC grain size 1.25 μm 14.3 wt-% Co The powder was spray dried and pressed into TNMG160408-PF inserts. The green bodies were dewaxed in $H_2$ and subsequently sintered in a $N_2$—CO—Ar atmosphere for 1.5 h at 1480° C. according to EP-A-1052297, which was followed by suitable edge treatment. Polished cross sections of inserts were prepared by standard metallographic techniques and characterized using scanning electron microscopy. FIG. 1 shows a scanning electron micrograph of such a cross section, taken in back scattering mode. As indicated in FIG. 1, the black particles (A) are the undissolved Ti(C,N) cores and the light grey areas (C) are the binder phase. The remaining grey particles (B) are the part of the hard constituents consisting of carbonitrides containing Ti, Nb and W. Using image analysis, the amount of undissolved Ti(C,N) cores was determined to be 29.8 vol % of the hard constituents.

EXAMPLE 2

Comparative

Inserts in a commercially available cermet turning grade (Alloy B) were manufactured and characterized in the same manner as described in Example 1. The composition of Alloy B is (at %) Ti 37.0%, W 3.7%, Ta 4.5%, Co 9.7% with a N/(N+C) ratio of 0.38.

Characterization was carried out in the same manner as described in Example 1. Using image analysis, the amount of undissolved Ti(C,N) cores was determined to be 35.6% of the hard constituents.

EXAMPLE 3

Cutting tests in a work piece requiring a cutting tool with high toughness were done with the following cutting data:

Workpiece material: SS2234, V=210 m/min, f=0.35 mm/r, d.o.c.=0.5 mm, with coolant.

Results:

Number of passes to fracture (5 edges tested):

| | Edge number | | | | |
|---|---|---|---|---|---|
| | 1 | 2 | 3 | 4 | 5 |
| Alloy A | 170 | 155 | 197 | 162 | 152 |
| Alloy B | 63 | 132 | 90 | 155 | 140 |

EXAMPLE 4

Wear resistance tests of Alloys A and B by longitudinal turning were done using the following cutting data:

Work piece material: Ovako 825B

V=250 m/min, f=0.15 mm/r, d.o.c.=1 mm, with cooling

Tool life criterion was Vb≧0.3 mm.

Results:

Tool life in minutes (average of 3 edges):

Alloy A: 26

Alloy B: 27

From examples 3 and 4 it is obvious that the alloy produced according to the invention has significantly improved toughness compared to the commercial material without showing a significant deterioration in wear resistance.

EXAMPLE 5

Comparative

An Alloy C of the same nominal composition as Alloy A was produced and characterized in an identical manner except for the sintering temperature which was 1510° C. Using image analysis, the amount of undissolved Ti(C,N) cores was determined to be 21.1 vol % of the hard constituents.

EXAMPLE 6

Wear resistance tests of alloys A and C by longitudinal turning were done using the following cutting data:

Work piece material: Ovako 825B

V=250 m/min, f=0.15 mm/r, d.o.c.=1 mm, with cooling

Tool life criterion was Vb>0.3 mm.

Results:

Tool life in minutes (average of 3 edges):

Alloy A: 26

Alloy C: 21

EXAMPLE 7

Plastic deformation resistance for alloys A and C was determined in a test comprising facing towards the center in a tube blank, with the following cutting data:

Work piece material: SS2541

V=varying between 350 and 500 m/min, f=0.3 mm/r, d.o.c.=1 mm, no coolant

The result below shows the cutting speed in m/min when the edges were plastically deformed (average of 3 edges):

A: 400

C: 375

EXAMPLE 8

Cutting tests in a work piece requiring a cutting tool with high toughness were done with the following cutting data:

Workpiece material: SS2234, V=210 m/min, f=0.35 mm/r, d.o.c.=0.5 mm, with coolant.

Results:

Number of passes to fracture (5 edges tested):

| | Edge number | | | | |
|---|---|---|---|---|---|
| | 1 | 2 | 3 | 4 | 5 |
| Alloy A | 170 | 155 | 197 | 162 | 152 |
| Alloy C | 172 | 153 | 205 | 167 | 158 |

From these results it was concluded that no significant difference in toughness between Alloys A and C was observed.

It is obvious from examples 6 through 8 that the alloy produced according to the invention has improved wear resistance with at least maintained toughness and resistance to plastic deformation.

EXAMPLE 9

An Alloy D, of nominal composition (at %) Ti 35.9%, W 3.6%, Nb 4.3%, Co 12.4% and a C/(N+C) ratio of 0.62, was prepared by wet milling:

53.5 wt-% $TiC_{0.58}N_{0.42}$ with a grain size of 1.43 μm;

11.2 wt-% NbC grain size 1.75 μm;

17.3 wt-% WC grain size 1.25 μm; and 18.0 wt-% Co.

The powder was spray dried and pressed into TNMG160408-PF inserts. The green bodies were dewaxed in $H_2$ and subsequently sintered in a $N_2$—CO—Ar atmosphere for 1.5 h at 1480° C., according to EP-A-1052297, which was followed by suitable edge treatment. The inserts were coated with a wear-resistant PVD Ti(C,N) coating. Polished cross sections of inserts were prepared by standard metallographic techniques and characterized using scanning electron microscopy. Using image analysis, the amount of undissolved Ti(C,N) cores was determined to be 31.5 vol % of the hard constituents.

EXAMPLE 10

Comparative

Inserts in a commercially available grade (Alloy E) were manufactured and characterized in the same manner as described in Example 9. The composition of Alloy E is (at %) Ti 35.9%, W 3.6%, Ta 4.3%, Co 12.4% with a C/(N+C) ratio of 0.62. Using image analysis, the amount of undissolved Ti(C,N) cores was determined to be 37.6 vol % of the hard constituents.

EXAMPLE 11

Cutting tests in a work piece requiring a cutting tool with high toughness were done with the following cutting data:

Workpiece material: SS2234, V=200 m/min, f=0.4 mm/r, d.o.c.=0.5 mm, with coolant.

Results:

Number of passes to fracture (5 edges tested):

| | Edge number | | | | |
|---|---|---|---|---|---|
| | 1 | 2 | 3 | 4 | 5 |
| Alloy D | 157 | 148 | 140 | 168 | 135 |
| Alloy E | 117 | 87 | 95 | 145 | 125 |

Obviously, the inserts produced according to the invention have substantially improved toughness compared to the commercial material.

EXAMPLE 12

Wear resistance tests of Alloys D and E by longitudinal turning were done using the following cutting data:

Work piece material: Ovako 825B

V=250 m/min, f=0.15 mm/r, d.o.c.=1 mm, with cooling

Tool life criterion was Vb≧0.3 mm.

Results:

Tool life in minutes (average of 3 edges):

Alloy D: 29

Alloy E: 31

It is clear from examples 11 and 12 that the alloy produced according to the invention has superior toughness as compared to the commercially available material, whereas the wear resistance of the two is at a comparable level.

The described embodiments of the present invention are intended to be illustrative rather than restrictive, and are not intended to represent every possible embodiment of the present invention. Various modifications can be made to the disclosed embodiments without departing from the spirit or scope of the invention as set forth in the following claims, both literally and in equivalents recognized in law.

We claim:

1. A method of manufacturing a sintered titanium-based carbonitride alloy comprising hard constituents with undissolved Ti(C,N) cores, the method comprising:

mixing hard constituent powders of $TiC_xN_{1-x}$, x having a value of 0.46–0.70, NbC and WC with powder of Co, pressing the mixture into bodies of desired shape and sintering the bodies in a $N_2$—CO—Ar atmosphere at a temperature in the range 1370–1500° C. for 1.5–2 h to obtain the desired amount of undissolved Ti(C,N) cores, wherein the amount of Ti(C,N) powder is 50–70 wt-% of the powder mixture, its grain size is 1–3 μm, and the sintering temperature and sintering time are chosen to give an amount of undissolved Ti(C,N) cores between 26 and 37 vol % of the hard constituents.

2. The method of claim 1, wherein the amount of undissolved Ti(C,N) cores is between 27 and 35 vol. %.

3. The method of claim 2, wherein the amount of undissolved Ti(C,N) cores is between 28 and 32 vol. %.

4. The method of claim 1, wherein the value of x is 0.52–0.64.

5. The method of claim 4, wherein the value of x is 0.55–0.61.

6. The method of claim 1, wherein an amount of $TiC_xN_{1-x}$ is about 53 to about 57 wt. %.

7. The method of claim 6, wherein an amount of NbC is about 11 wt. % and the amount of WC is about 17 wt. %.

8. The method of claim 1, wherein an amount of Co is 9–16 at %.

9. The method of claim 8, wherein the amount of Co is 9–<12 at %.

10. The method of claim 9, wherein the amount of Co is 9–10.5 at %.

11. The method of claim 8, wherein the amount of Co is 12–16 at %.

12. The method of claim 11, wherein the amount of Co is 12–14.5 at %.

* * * * *